US010907626B2

(12) United States Patent
Fang et al.

(10) Patent No.: US 10,907,626 B2
(45) Date of Patent: Feb. 2, 2021

(54) PERISTALTIC PUMP WITH REDUCED TRIBOELECTRIC EFFECTS

(71) Applicant: Biosense Webster (Israel) Ltd., Yokneam (IL)

(72) Inventors: Itzhak Fang, Irvine, CA (US); Andrei Szilagyi, Fullerton, CA (US); Alexander Lifshitz, Arcadia, CA (US); Jack Walker, Sunnyvale, CA (US); Sean Yasuo Sullivan, Mountain View, CA (US)

(73) Assignee: BIOSENSE WEBSTER (ISRAEL) LTD., Yokneam (IL)

( * ) Notice: Subject to any disclaimer, the term of this patent is extended or adjusted under 35 U.S.C. 154(b) by 71 days.

(21) Appl. No.: 15/434,465

(22) Filed: Feb. 16, 2017

(65) Prior Publication Data

US 2018/0230988 A1 Aug. 16, 2018

(51) Int. Cl.
*F04B 43/12* (2006.01)
*F04B 43/00* (2006.01)

(52) U.S. Cl.
CPC ..... *F04B 43/1253* (2013.01); *F04B 43/0072* (2013.01)

(58) Field of Classification Search
CPC .. F04B 43/1253; F04B 43/0072; F04B 43/00; F04B 43/12
USPC ..... 417/476–477.14
See application file for complete search history.

(56) References Cited

U.S. PATENT DOCUMENTS 4,976,590 A * 12/1990 Baldwin ..... F04B 43/1253 417/477.3
5,387,088 A * 2/1995 Knapp ..... F04B 43/1253 417/477.1
7,771,179 B2 * 8/2010 Kubota ..... F04B 43/1253 417/474
9,101,269 B2 8/2015 Selkee
2013/0115120 A1 * 5/2013 Jarnagin ..... F04B 43/1284 417/477.2

FOREIGN PATENT DOCUMENTS

DE 20109803 U1 10/2002
EP 0638322 A1 2/1995
JP H-0942159 A * 2/1997

OTHER PUBLICATIONS

Human translation provided by Steven M. Spar of paragraph 31 in JPH0942159 obtained on Jul. 16, 2020. (Year: 2020).*
Extended European Search Report for European Application No. EP18156943, dated Jun. 20, 2018, 7 pages.

* cited by examiner

*Primary Examiner* — Kenneth J Hansen
*Assistant Examiner* — Chirag Jariwala
(74) *Attorney, Agent, or Firm* — Etan S. Chatlynne; Roberts Calderon Safran & Cole P C.

(57) ABSTRACT

A pump for use with a tube, having a rotor having an axis of rotation and a plurality of rollers configured to define an orbital path about the axis of rotation, the orbital path defined by a radius, and a roller bed having a surface adapted to support the tube for peristaltic compression by one or more rollers, wherein the surface has a predetermined profile comprising a circular arc segment and at least one side segment, the arc segment having a first curvature defined by the radius, and the at least one side segment having a second curvature lesser than the first curvature.

10 Claims, 6 Drawing Sheets

PERISTALTIC PUMP WITH REDUCED TRIBOELECTRIC EFFECTS

FIELD OF INVENTION

The present invention relates to an improved medical peristaltic pump.

BACKGROUND

Peristaltic pumps are a type of positive displacement pump used for pumping a variety of fluids. The fluid is contained within a flexible tube fitted inside a pump casing. The pump operates by peristalsis which is based on alternating compression and relaxation of the tube, drawing content in and propelling the content out. The peristaltic pump is therefore an accurate dosing pump, with an equal amount of liquid dosed each time.

The liquid being pumped never comes into contact with any moving pump parts because it is contained within the tube. A conventional peristaltic pump includes one or more rotating shoes or rollers that pass along the length of tube throughout the pumping cycle, with each shoe or roller creating a total seal between suction side and discharge side of the pump. To prevent uncontrolled fluid backflow, at least one such roller must be compressing the tube at all times. Driven by a variable speed drive (not shown), a pump rotor brings successive the shoes or rollers to create the sealing pressure against a roller bed, which moves along the tube forcing the liquid to move away from the pump for discharge.

In conventional parlance, as the rotor turns, the part of the tube under compression is pinched closed (or is occluded) thus forcing the liquid to be pumped and to flow through the tube. As the tube opens to its natural state after the passing of the rollers ("restitution" or "resilience") fluid flow is induced to the pump. Thus, where the pressure has been released the tube recovers creating a vacuum, which primes the pump by drawing the liquid into the suction side of the pump. The combination of the suction and the discharge action results in a self-priming positive displacement pump.

The flow rate of the pump is related directly to the diameter of the tube and the speed of rotation of the drive (not shown). The pump duty is limited by the tube material of construction. The suction capabilities are related to the ability of the tube to rapidly expand after compression.

A typical catheterization system includes a catheter which is inserted through a patient's vascular system into a chamber or vascular structure of the heart. The catheter's distal tip is brought into contact with the heart wall for obtaining electrical and positional information that is processed by a console that includes a processor for generating activation maps, anatomical positional information and other functional images. The system typically includes an electrocardiogram (ECG) monitor coupled to receive signals from one or more body surface electrodes. The ECG signal is typically received through an interface with the console, e.g., a patient interface unit having an analog input and an isolated ground may be used to provide an ECG synchronization signal to the console.

An electrically conductive fluid, e.g., saline, is delivered through a lumen in the catheter from a reservoir via a hydraulic line. The lumen terminates in exit pores through which the liquids emerge to cool an ablating electrode at the distal portion of the catheter and also the tissue ablation site. A peristaltic pump is connected to the hydraulic line and causes the fluid to be delivered to the catheter at a desired rate. One difficulty with such an arrangement is that the equipment operates in the presence of environmental electrical effects, some of which are produced by the pump itself. For instance electrical noise originating in the pump can be picked up by the hydraulic line and can interfere with the analysis and display of the intracardiac ECG on the monitor. The electrical emissions or signals are usually observed in ECG leads connected to a patient who is being transfused or infused with the electrically conductive solution. Any unintentional electrical currents that flow in the patient's body as a result of this potential are sensed as characteristic noise added to the ECG signals.

This noise has been observed in patients connected to a peristaltic pump for cardiac assist, dialysis treatments and irrigation of an ablation catheter used in treating cardiac arrhythmias. Many sources have been proposed as sources for the noise, some focusing on the pump itself.

Without being bound by any particular theory, the following discussion as set forth in U.S. patent application Ser. No. 13/327,448, filed Dec. 15, 2001, entitled ELECTROGRAM NOISE REDUCTION, the entire content of which is incorporated herein by reference, is offered to facilitate understanding of the various embodiments described and disclosed herein: In one respect the hydraulic line may function as a receiving antenna that collects noise from the surrounding environment and may constitutes one source of the noise. In another respect, the pump may be another source of electrical noise, created by a triboelectric effect, whereby an induced charge is created on the surface of flexible tubing used in the pump and on the surface of the rotor surfaces used to compress the tubing. The rubbing or deforming action of the rotor against the tubing surface displaces electrical charge. Some of the charge is collected on the rotor and some is collected on the tubing surface. The tubing wall is generally an insulator, so that the external charge on the outside surface of the tube is induced on the inside of the tubing bore if the fluid in the tubing is an electrical conductor. In consequence, a generator potential appears between the electrically conductive fluid and the pump rotor. Any electrical circuit connecting these two points allows current to flow. Such current, if sensed or intercepted by the EKG circuitry, produces undesirable signals on the EKG tracing that are perceived as "ECG noise" by the operator. Because the triboelectric potential appears in series with the capacitance of the external and internal tubing walls, which are generally insulators (plastic), the triboelectric current has bursty characteristics.

Additionally or alternatively, the observed current may arise from a piezoelectric effect in the tubing walls. Further additionally or alternatively, there appears to be a strong amplification mechanism resulting from the motion of the tubing walls as they are squeezed between the rotor rollers and the pump race, causing a dynamic change in tubing capacitance, which is in series with the triboelectric charge.

The noise, as observed on intracardiac ECG recordings, appears as spikes, making the ECG signals difficult to interpret, and these spikes (typically ranging between about 0.05 mV and 0.2 mV) can even be confused as ECG waves themselves. Additionally, a fast Fourier transform applied to the noise to obtain its power spectrum finds component sinusoids at repetition frequencies equal to the impact rate of the rotor rollers (N) on the tubing surface along with higher harmonics. The repetition frequencies are dependent on the number of rollers in a rotor, and are to be distinguished from the rotor rotation rate itself.

Treatments to reduce the noise have included lining the pump roller and roller bed, coating the pump hydraulic line with an antistatic chemical, and/or wetting the contact surfaces of these components. However, the reduction tends to be insignificant and/or temporary.

SUMMARY OF THE INVENTION

Whereas prior efforts have been focused more on reducing friction between the tube and surfaces that contact the tube, the present invention seeks to increase friction between at least the tube and the roller bed on which the tube rests. The present invention recognizes that as the tube is repeatedly struck by the rollers the tube is subjected to displacement forces that cause axial, lateral and/or vertical movements relative to the pump. Vertical movement occurs each time a roller engages the tube, and as the roller passes over the tube the roller tends to stretch the upper portion of the tube causing the tube to be lifted off the roller bed. With such repeated lifting motion, the tube comes in and out of contact with the roller bed as a relevant, if not significant, source of triboelectric charge. The present invention seeks to minimize concussive forces acting on the tube which may shift or lift the tube by defining, controlling and optimizing various parameters of operation, including, for example, the manner of engagement between the rollers and the tube and the duration of engagement between them.

Accordingly, the present invention is directed to a pump for use with a tube, the pump having: a rotor having an axis of rotation and a plurality of rollers configured to define an orbital path about the axis of rotation, the orbital path defined by a radius, and a roller bed having a surface adapted to support the tube for peristaltic compression by one or more rollers, wherein the surface has a predetermined profile comprising an arc segment and at least one side segment, the arc segment having a first curvature defined by the radius, and the at least one side segment having a second curvature lesser than the first curvature.

The orbital path may include a circular orbital path.

The at least one side segment may include a linear segment.

The arc segment may span between about +30 degrees and −30 degrees from an axis centered and perpendicular to the surface.

The arc segment may span between about +40 degrees and −40 degrees from an axis centered and perpendicular to the surface.

The arc segment may span between about +35 degrees and −35 degrees from an axis centered and perpendicular to the surface.

The at least one side segment may span between about +35 degrees and +40 degrees from an axis centered and perpendicular to the surface.

The at least one side segment may span between about +35 degrees and +70 degrees from an axis centered and perpendicular to the surface.

The at least one side segment may span between about +35 degrees and +55 degrees from an axis centered and perpendicular to the surface.

The at least one side segment may span between about −35 degrees and −40 degrees from an axis centered and perpendicular to the surface.

The at least one side segment may span between about −35 degrees and −70 degrees from an axis centered and perpendicular to the surface.

The at least one side segment may span between about −35 degrees and −55 degrees from an axis centered and perpendicular to the surface.

The roller bed may include a groove formed on its surface.

The surface of the roller bed may include a controlled friction portion.

At least one roller may have a profile including a recessed track.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
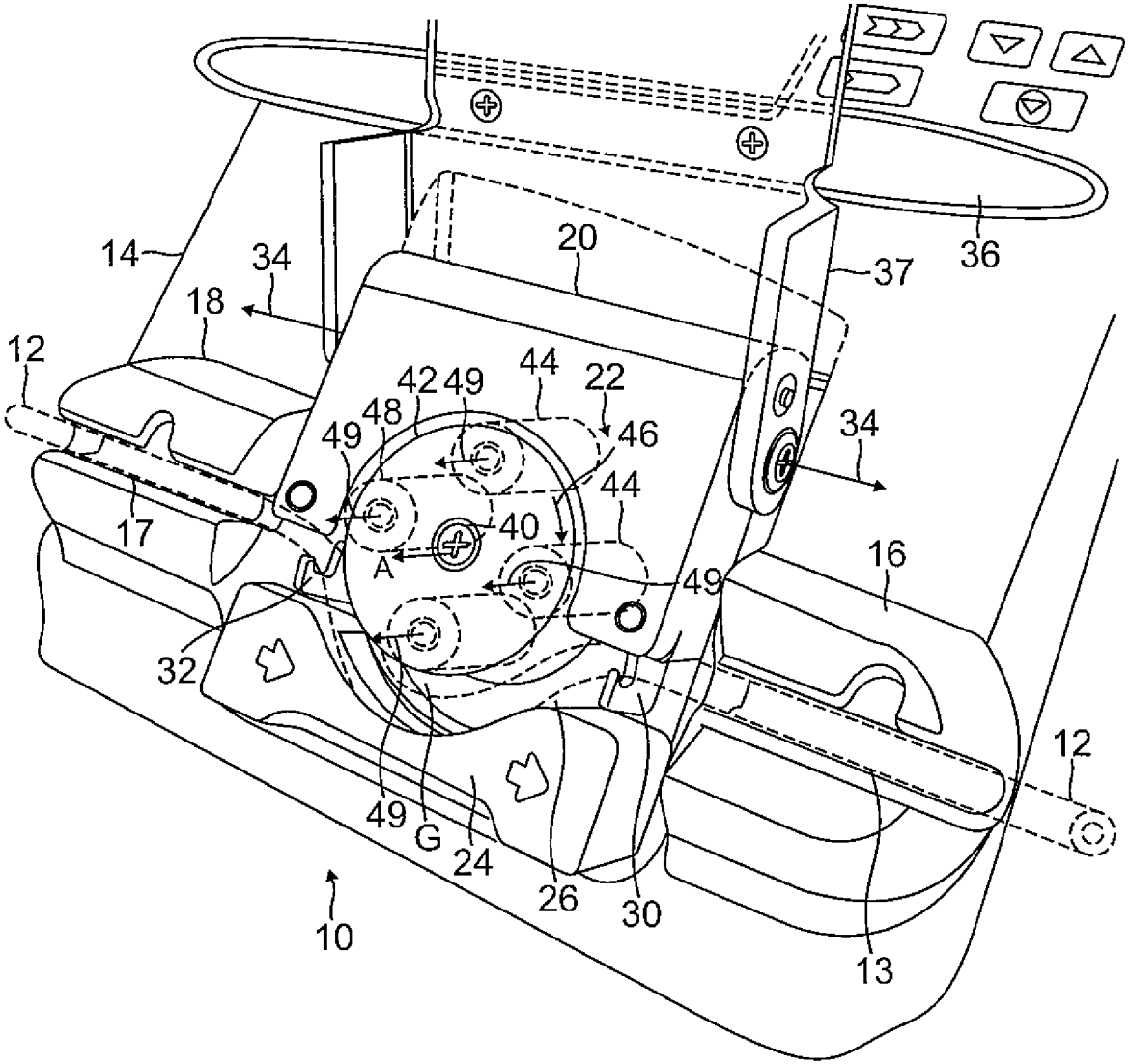
FIG. 1 is a perspective view of a pump of the present invention, with a cam member in an open position, in accordance with an embodiment.

As shown in FIG. 1, the present invention includes a pump 10 configured to receive a tubing 12 (represented by broken lines for better clarity) for passing liquid therethrough by peristaltic action. The pump has a housing 14 configured with a suction port 18, a discharge port 16 and a rotor housing 20 therebetween. The tubing 12 extends through a channel 17 in the suction portion 18, the rotor housing 20, and a channel 13 in the discharge port 16. The rotor housing 20 includes a rotor 22, a roller bed 24, and an engagement member 26 supporting the roller bed 24, and intake and discharge tube clamps 32 and 30 on opposing sides of the rotor 22. The engagement member 26 extends from behind the rotor 22 and can be lifted and lowered relative to the rotor 22 by a handle 36 extending from a mounting bracket 37 that is pivotably coupled to an upper portion of the rotor housing 20 about axis 34 in moving the roller bed 24 and the clamps 30 and 32 relative to the rotor 22 between an open position (FIG. 1) where a separation distance S of a gap G between the rotor 22 and the roller bed 24 is at a predetermined maximum, and a closed position (FIG. 2) where the separation distance S of the gap G is at a predetermined minimum.

The rotor 22 has at least one circular plate member 42 to which a plurality of rollers 44A-44D are mounted perpendicularly along a peripheral edge region 48 of the plate 42. Driven by a variable speed drive (not shown), a shaft (represented by screw 40) drives the rotor 22 to rotate about central axis A. As the rotor 22 rotates, the rollers 44A-44D travel in a circular direction (for example, counterclockwise) defining an orbital path 46 about the central axis A. Because it is the outer surface of the rollers 44A-44D that engages with the tube 12 for peristaltic compression, "orbital path"

as used herein is defined as the circle traced by the outer surface of the rollers 44A-44D (and not the peripheral edge of the plate member 42) as the rotor 22 rotates. (It is understood that alternate embodiments, for example, rotors with different size rollers and/or rollers mounted at a different distance from the rotor shaft will define different orbital paths.)

Each roller 44A-44D is also configured to rotate freely about their respective axes 49, each of which is parallel to the central axis A. With the engagement member 26 in the closed position (FIG. 2), the roller bed 24 is raised so that the tube 12 is brought into a closer position for engagement with the rollers 44 in a continual succession which compresses and releases the tube 12 thereby creating suction and discharge of the liquid contained in the lumen of the tube 12. As the present invention recognizes that a source of triboelectric charge arises at least in part from the tube 12 and rollers 44A-44D coming in and out of contact with each other, the pump 10 of the present invention incorporates several structural features, as described below in further detail, to reduce and minimize the source and/or accumulation of triboelectric charge in or on the tube 12 and/or other components of the pump 10.

Figure 2:
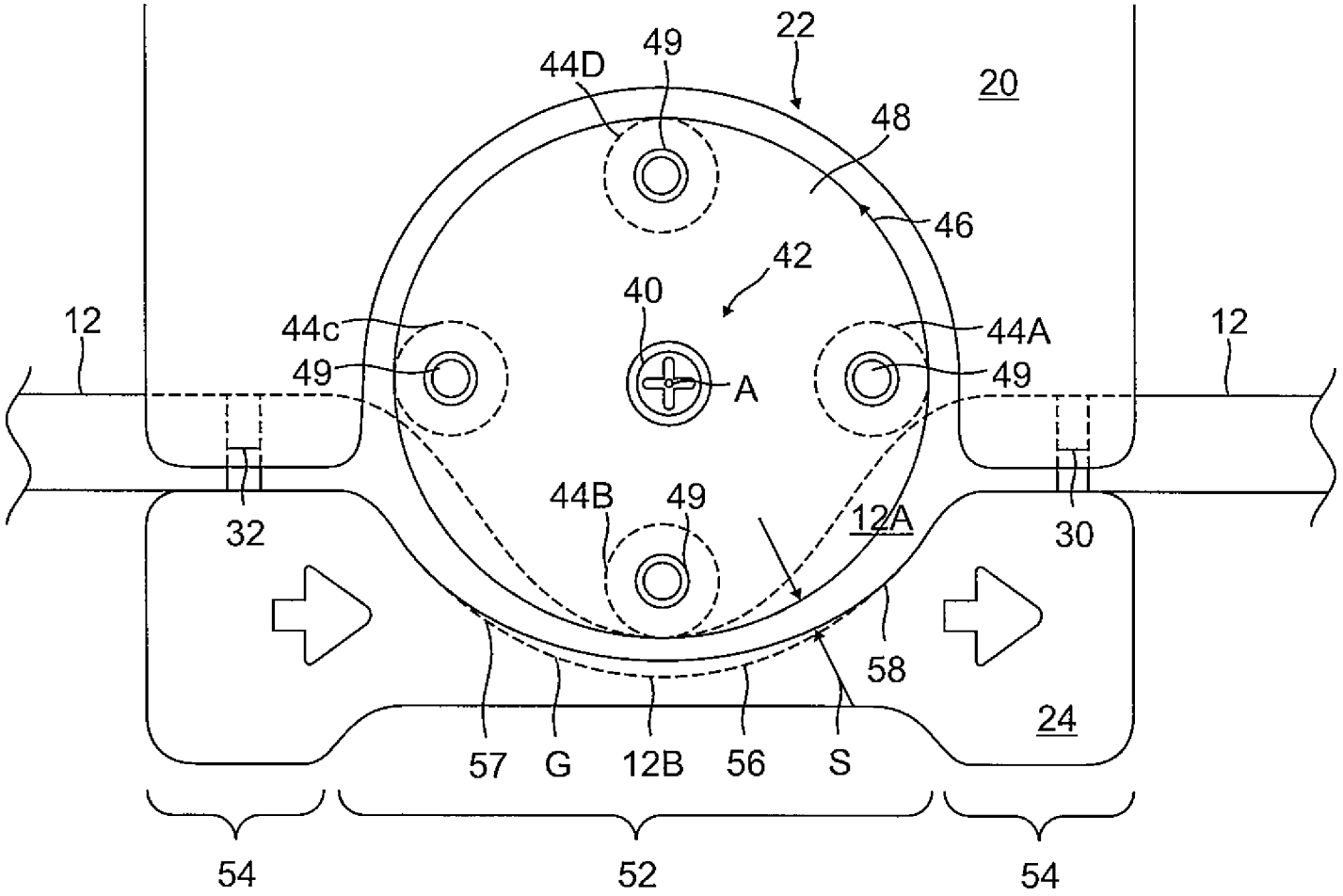
FIG. 2 is a front view of the pump of FIG. 1, with the cam member in a closed position.
Figure 3:
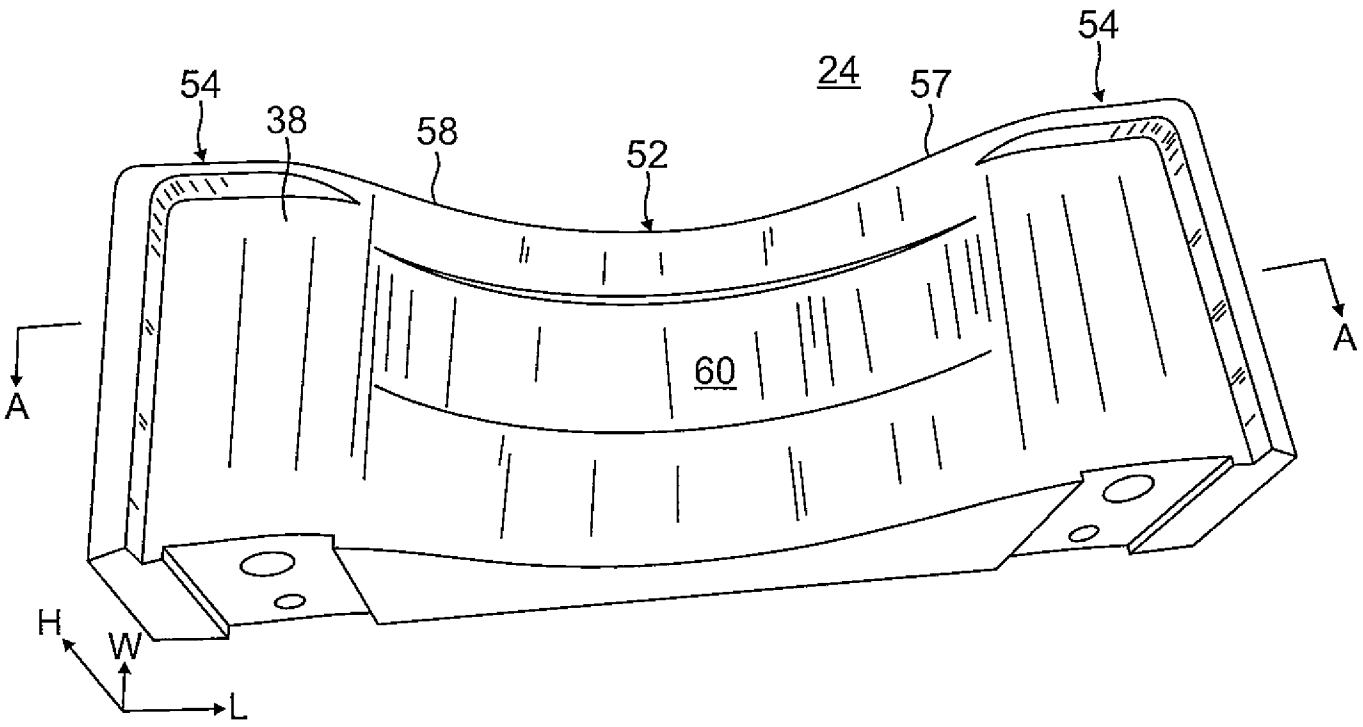
FIG. 3 is a top perspective view of a roller bed of the present invention, in accordance with a first embodiment.
Figure 5:
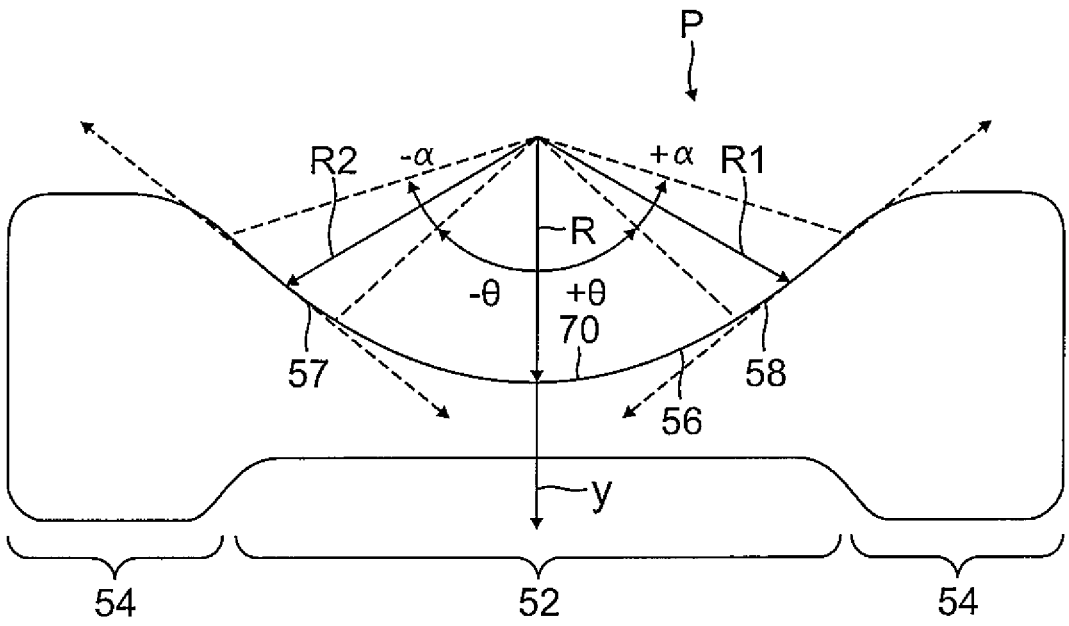
FIG. 5 is a side elevational view of a roller bed of the present invention, in accordance with a third embodiment.

As shown in FIG. 3, the roller bed 24 has a generally elongated solid body with a length dimension L, a width dimension W and height dimension H. The body has an upper surface 38 on which the tube 12 rests or is otherwise in position for engagement with the rollers 44. The body of the roller bed 24 can be described as having a main section 52 which is thinner in the height dimension H, and opposing edge sections 54 which are thicker in the height dimension H. The upper surface 38 of the main section 52 is configured with a generally concave shape or concavity, which may be better seen in FIG. 5. The concavity is configured correspondingly and in relation to the orbital path 46 defined by the rollers 44A-44D. The main section 52 is thus configured not only to receive the tube 12, but also, when the engagement member 26 is in the closed position, to support the tube 12 in a conforming manner as the tube 12 and the rollers 44A-44D engage with each other (FIG. 2). As shown in FIG. 5, the concavity has a predetermined profile P that includes an arc segment 56 with a selected curvature, and intake and discharge side segments 57 and 58, each with a lesser curvature than the arc segment 56.

In some embodiments, the arc segment 56 of the profile P includes a circular arc segment 70 that generally traces the orbital path 46 and is generally concentric with the central axis A of the rotor 22. As such, the circular arc segment 70 has a curvature defined by a circle with radius R+S where R is generally equal to the radius of the orbital path 46, and S is the separation distance in gap G, and the segment 70 spans between angles $+\theta$ and $-\theta$ relative to a plumb line axis Y positioned at a centered-location of the roller bed 24, as shown in FIG. 5, where $\theta$ ranges between about 30-40 degrees, and preferably equals about 35 degrees. Advantages of the circular arc segment 70 include ensuring that the tube 12 is compressed sufficiently by the rollers 44A-44D against the roller bed 24 at least somewhere along the segment 70, for example, on the plumb line axis Y, to create a vacuum seal for efficient pumping action. Note that the angular extent of the circular arc segment 70 must be sufficiently long in the length dimension L so that a second roller enters its span from the intake side before a first roller exits toward the discharge side.

The side intake and discharge segments 57 and 58 that flank the arc segment 56 of the profile P span between ($+\theta$ and $+\alpha$) and ($-\theta$ and $-\alpha$), respectively, with $\alpha$ ranging between about 40-70 degrees, and preferably being about 55 degrees, from the plumb line axis Y. Taking the curvature of segment 70 to be positive and equal to 1/R, each of the segments 57 and 58 may have a lesser, or even a negative, curvature. In some embodiments, the side segments 57 and 58 may include a linear segment and/or a segment with an absolute value of the curvature $\kappa$ in the range $|\kappa| \leq 1/R$. It is useful to note that the intake segment 57 is where rollers 44A-44D first impact tube 12. Close support of the tube by the intake segment 57 in that region would minimize forcible and sudden movements of the tube 12. Contrariwise, at the discharge segment 58, sudden release of the tube 12 by a roller 44A-44D does not lead to the same forcible and sudden type of tube movement. This difference in behavior accounts for different designs options at the two segments 57 and 58.

Having a lesser curvature, the side segments 57 and 58 can better conform to any one or more portions of the tube 12 that may lift off from and lose contact with the upper surface 38 as these one or more tube portions come under tension and are stretched into a more linear configuration by the pinching action of the rollers 44A-44D. Thus, advantages provided by the side segments 57 and 58 include improved contact, for example, greater contact surface area, longer contact duration, and/or more consistent contact, between the tube 12 and the rollers 44A-44D to minimize the generation and/or the accumulation of triboelectric charges on the tube 12, the roller bed 24, and/or other components of the pump. Accordingly, the combination of the arc segment 56 and the side segments 57 and 58 ensures that the rollers 44A-44D engage the tube 12 in a desirable manner.

Figure 6:
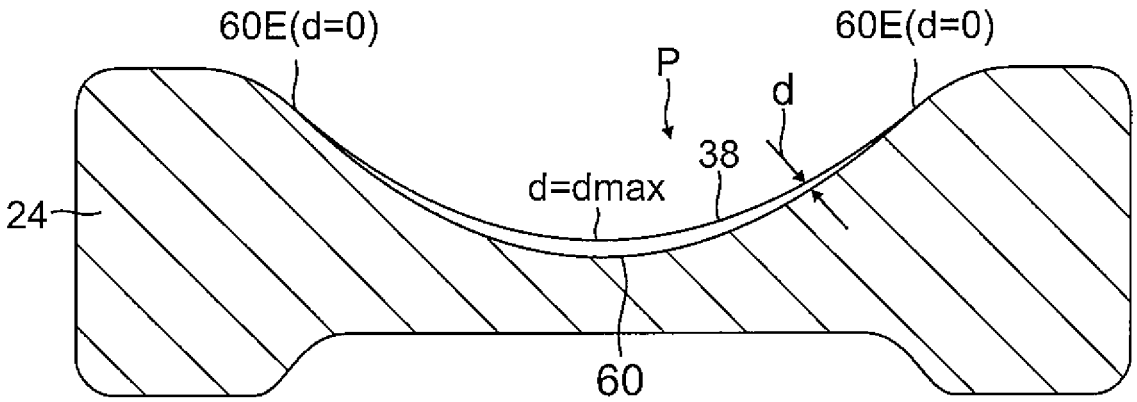
FIG. 6 is a side cross-sectional view of the roller bed of FIG. 3, taken along line A-A.
Figure 7:
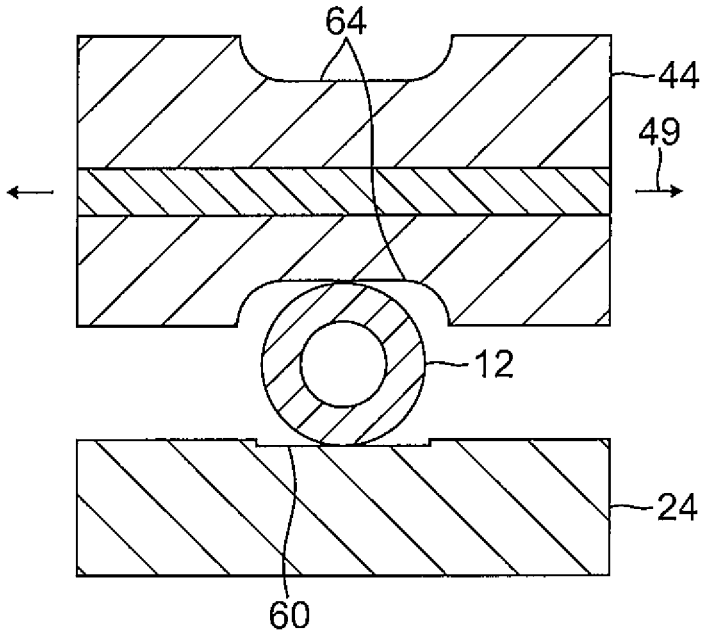
FIG. 7 is an end cross-sectional view of a tube positioned between a roller and a roller bed of the pump of FIG. 1.
Figure 8:
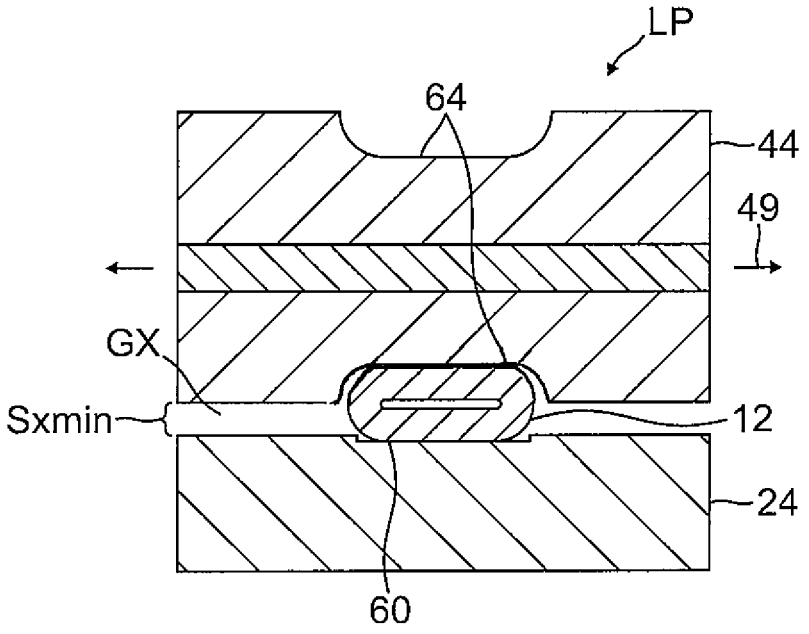
FIG. 8 is an end cross-sectional view of a tube being compressed between a roller and a roller bed of the pump of FIG. 1.

In some embodiments, the upper surface 38 of the roller bed 24 includes a generally centered longitudinal depression or groove 60 that extends lengthwise along at least the main section 52 of the roller bed, as shown in FIG. 3. The groove 60 is provided to help confine the tube position on the roller bed 24 and minimize lateral movement of the tube under the rollers 44A-44D, as shown in FIG. 7. The groove 60 has a sufficient width (in the width dimension W) to accommodate a maximum width of the tube 12 when compressed between the rollers 44A-44D and roller bed 24, as shown in FIG. 8. Expressed in terms of tube dimensions, this width should be no less than $\pi r+2w$, where r is the internal radius and w is the wall thickness. As shown in FIG. 6, the groove 60 has a tapered depth d that varies longitudinally, with a maximum groove depth dmax at a mid-location (e.g., plumb line intersection) of the concavity or profile P that smoothly and continuously diminishes to an even or flush surface (d=0) at opposing groove ends 60E. The maximum depth ranges between about w/10 and w/2, and is preferably about w/3.

It is understood that for a roller bed 24 that includes the groove 60, the groove 60 may be configured with the above-described profile P, with the surrounding upper surface 38 being a "raised" upper surface relative to the profile P of the groove in order to form and define the depression of the groove. In that regard, the raised upper surface surrounding the groove 60 may or may not follow the profile P, as desired or appropriate.

Figure 4:
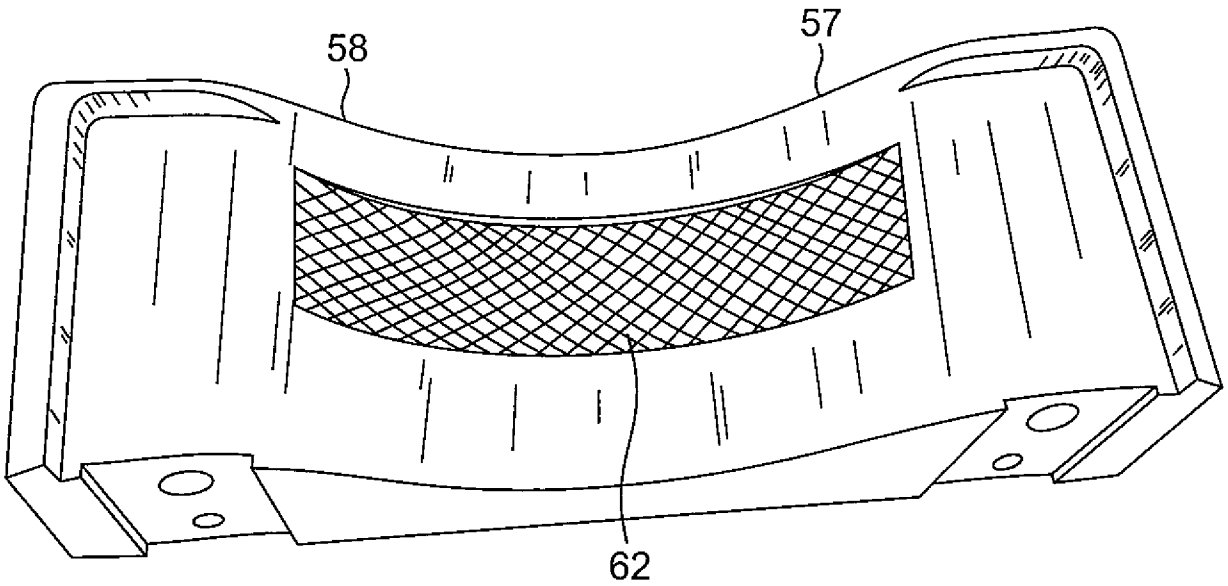
FIG. 4 is a top perspective view of a roller bed of the present invention, in accordance with a second embodiment.

In some embodiments, the upper surface of profile P includes a frictional (or textured) surface configured to reduce relative movement between the tube 12 and the upper surface of the roller bed 22. The frictional surface extends at least throughout the groove 60, and it may also extend on the outer surface beyond the groove 60. In some embodiments, the frictional surface includes uneven surface formations that may be formed by any suitable means including etching (mechanical or chemical), engraving, machining, sanding, and/or stamping into the upper surface 38. In some embodiments, the frictional surface includes a mesh or webbed layer 62 applied or bonded to the upper surface 38, as shown in FIG. 4. In some embodiments, the friction-inducing surface includes an adhesive coating applied to the groove 60 to help grip the tube 12. It is understood that a balance is met between a surface that is frictional versus a surface that is excessively abrasive, the latter of which may cause premature wear and tear of the tube 12.

In some embodiments, each roller 44A-44D has an outer surface with a lateral profile LP that is configured to help keep the tube 12 laterally centered on the upper surface 38 of the roller bed 24 and/or confined in the groove 60, as shown in FIG. 7 and FIG. 8. The profile LP includes a recessed track 64 that accommodates the cross-sectional form of the tube 12 in both its neutral (uncompressed) configuration (FIG. 7) and the compressed configuration (FIG. 8). In the illustrated embodiment, the recessed track 64 is formed in conformity with the cross-section form of the tube in the compressed configuration with sufficient compression to form a vacuum seal.

In use, an operator opens the engagement member 26 by lifting the handle 36. As the handle pivots about axis 34, the engagement member 26 is lowered to the open position, thus moving the roller bed 24 away from the rotor 22 to the maximum separation distance S. The operator positions the tube 12 on the clamps 30 and 32 and on the upper surface 38 of the roller bed 24 (and in the groove 60 if provided on the roller bed). The operator also positions the tube 12 in the channels 17 and 13, respectively, of the suction port 18 and the discharge port 16. With the tube so arranged, the operator may close the engagement member 26 by lowering the handle 36, thus moving the roller bed 24 toward the rotor 22. Depending on the angular positions of the rollers 44A-44D in their orbital path 46 around center axis A of the rotor 22, the tube 12 is lifted into contact and engagement with one or more rollers 44.

When a roller 44A-44D has an angular position in the arc segment 70, between the angles $+\theta$ and $-\theta$, the roller 44A-44D compresses the tube against the roller bed 24 upon closing of the engagement member 26 with sufficient force to create a vacuum seal. As shown in FIG. 8, a separation distance of a gap GX between an engaging roller 44 and the roller bed 24 is generally at a minimum SXmin when roller 44 is in the arc segment 70.

When a roller 44 is outside of the arc segment 70 but between the angles $+\alpha$ and $-\alpha$, the roller 44 is in a side segment 57 or 58. When the engagement member 26 is closed, the roller 44 comes into contact with the tube 12 with partial compression, either in the process of fully compressing the tube 12 (when in the intake segment 57) or releasing the tube 12 from compression (when in the discharge segment 58). As mentioned above, before a roller exits the proximity of segment 70, another one must enter it to provide continuous sealing and maintenance of the desired downstream pressure. When a roller is outside of the side segments 57 and 58 (at angles wider than $+\alpha$ and $-\alpha$), the roller 44 is poised to initiate compression or finish complete release of the tube 12.

As the operator activates the pump 10, the rotor 22 begins to rotate and the rollers 44 begin their orbital path 46 engaging the tube 12 in succession to advance liquid through the lumen of the tube via peristaltic action. As shown in FIG. 2, as a roller 44A first engages a portion 12A of the tube, the tube portion 12A is supported on the intake side segment 57. The profile P of the intake side segment 57 allows a smooth and gradual engagement with the roller 44A to prevent concussion to the tube portion 12A that may cause a sudden change in the nature and amount of contact with the roller bed 24. As the roller 44A passes over the tube portion 12A, the portion 12A is compressed with an increasing compression force, as enabled by the decreasing separation distance between the roller 44A and the roller bed 24. As the roller 44A advances from the side segment 57 onto the arc segment 56, the compression force reaches its maximum value which causes the roller 44A to drag the upper portion of the tube 12A that follows the roller 44A which in turn causes tension in the tube portion 12A against the clamp 32 holding an intake end of the tube portion 12A. Advantageously, the profile P of the side segment 57 provides less curvature (and more linearity), so that the tube portion 12A may remain in contact with the roller bed 24 despite its tendency to straighten under tension. The profile P provides a smooth transition between the segments 57 and 56 so that the increase in compression is gradual in minimizing concussion to the tube portion 12A. As such, the profile P of the intake side segment 57 allows a smooth and gradual engagement with the roller 44A to attenuate forces that may cause a sudden change in the nature and amount of contact with the roller bed.

With further reference to FIG. 2, as a roller 44B passes through the arc segment 56, compression of tube portion 12B by the roller 44B is at a maximum to provide a vacuum seal in the tube portion 12B. As the profile P of the arc segment 56 is circular and concentric with the orbital path 46 of the roller 44, the contact between the roller and the tube portion 12B remains generally consistent. As the roller 44B advances toward the discharge side, hydrostatic fluid pressure increases ahead of it due to flow through a narrow channel as well as the inflation of a limited volume with elastic boundaries (e.g. the vascular system of a human subject.)

As the roller 44B passes from the arc segment 56 onto discharge side segment 58, the compression of the tube portion 12B begins to decrease as the separation distance between the roller 44B and roller bed 24 increases due to the increased linearity of the profile P in the discharge segment 58, and roller 44B releases the vacuum seal. By that time another roller has created a seal and captured fluid behind roller 44B. That fluid is pressurized and equilibrated to the downstream pressure as soon as the seal of the leading roller is released. The pulsatile pressure behavior is an accepted characteristic of peristaltic pumps. The profile P provides a smooth transition between the arc segment 56 and the discharge side segment so that the release is gradual in minimizing the tube from springing back into the neutral configuration and losing contact with the roller bed. As such, the profile P of the intake side segment 57 allows a smooth and gradual disengagement from the rollers to prevent a rebound force that may cause a sudden change in the nature and amount of contact with the roller bed.

By minimizing concussive and tension forces exerted by the rollers 44 on the tube 12, the pump of the present invention reduces the creation and/or accumulation of triboelectric charges on the tube and/or other components of the pump.

The preceding description has been presented with reference to certain exemplary embodiments of the invention. Workers skilled in the art and technology to which this invention pertains will appreciate that alterations and changes to the described structure may be practiced without meaningfully departing from the principal, spirit and scope of this invention, and that the drawings are not necessarily to scale. Moreover, it is understood that any one feature of an embodiment may be used in lieu of or in addition to feature(s) of other embodiments. Accordingly, the foregoing description should not be read as pertaining only to the precise structures described and illustrated in the accompanying drawings. Rather, it should be read as consistent with and as support for the following claims which are to have their fullest and fairest scope.

What is claimed is:

1. A pump for use with a tube, the pump comprising:

a rotor having an axis of rotation and a plurality of rollers configured to define an orbital path about the axis of rotation, the orbital path defined by a radius, and a roller bed having a surface adapted to support the tube for peristaltic compression by the plurality of rollers, wherein the surface has a predetermined profile comprising a circular arc segment and at least one side segment that flanks the circular arc segment, the circular arc segment having a first curvature defined by the radius, and the at least one side segment having a second curvature lesser than the first curvature, wherein the circular arc segment spans from between about +30 degrees and about −30 degrees to between about +40 degrees and about −40 degrees relative to a plumb line axis, wherein the at least one side segment begins at a point where the circular arc segment ends and spans up to about thirty degrees to about forty degrees beyond the point, wherein a groove is formed on the surface, the groove including a tapered depth and a maximum depth proximate to a location where the plumb line axis intersects the surface, and wherein the tube includes a width and the maximum depth ranges between about one tenth of the width to about one half of the width.

2. The pump of claim 1, wherein the orbital path includes a circular orbital path.

3. The pump of claim 1, wherein the at least one side segment includes a linear segment.

4. The pump of claim 1, wherein at the plurality of rollers each have a profile including a recessed track.

5. The pump of claim 1, wherein the maximum depth equals about one third of the width.

6. The pump of claim 1, wherein the circular arc segment spans between about +35 degrees and about −35 degrees relative to the plumb line.

7. The pump of claim 1, wherein the at least one side segment spans about 15 degrees beyond the point.

8. The pump of claim 1, wherein the surface of the roller bed includes a textured surface configured to reduce relative movement between the tube and the surface.

9. The pump of claim 8, wherein the textured surface includes a mesh layer bonded to the surface.

10. The pump of claim 8, wherein the textured surface includes an adhesive coating.

* * * * *